US007874342B2

(12) United States Patent
Mullet et al.

(10) Patent No.: US 7,874,342 B2
(45) Date of Patent: Jan. 25, 2011

(54) WIND RESISTANT MOVABLE BARRIER

(75) Inventors: Willis J. Mullet, Gulf Breeze, FL (US); Thomas B. Bennett, III, Wooster, OH (US); Albert W. Mitchell, Cantonment, FL (US)

(73) Assignee: Overhead Door Corporation, Lewisville, TX (US)

( * ) Notice: Subject to any disclaimer, the term of this patent is extended or adjusted under 35 U.S.C. 154(b) by 574 days.

(21) Appl. No.: 11/211,296

(22) Filed: Aug. 24, 2005

(65) Prior Publication Data

US 2007/0044927 A1 Mar. 1, 2007

(51) Int. Cl.
*E04B 1/346* (2006.01)
*E04B 7/16* (2006.01)

(52) U.S. Cl. ..... 160/201; 160/229.1

(58) Field of Classification Search ..... 160/235, 160/190, 229.1, 188, 232, 201, 236, 209; 248/224.8

See application file for complete search history.

(56) References Cited

U.S. PATENT DOCUMENTS

| | | | | | |
|---|---|---|---|---|---|
| 2,017,012 | A | * | 10/1935 | Morgan | 160/190 |
| 2,166,746 | A | * | 7/1939 | Bartel | 160/191 |
| 2,883,697 | A | * | 4/1959 | Stroup | 16/97 |
| 2,886,102 | A | * | 5/1959 | Olsen et al. | 160/235 |
| 3,376,913 | A | | 4/1968 | Clapsaddle | 160/201 |
| 3,967,671 | A | | 7/1976 | Stanley et al. | 160/232 |
| 3,980,123 | A | * | 9/1976 | Vago | 160/201 |
| 4,460,030 | A | | 7/1984 | Tsunemura et al. | 160/35 |
| 5,060,711 | A | | 10/1991 | Fimbell, III | 160/229.1 |
| 5,133,108 | A | * | 7/1992 | Esnault | 16/225 |
| 5,148,850 | A | * | 9/1992 | Urbanick | 160/231.1 |
| 5,314,325 | A | | 5/1994 | Bosler | 425/384 |
| 5,365,993 | A | | 11/1994 | Jella | 160/201 |
| 5,435,108 | A | | 7/1995 | Overholt et al. | 52/309.11 |
| 5,445,208 | A | | 8/1995 | Shaner et al. | 160/232 |

(Continued)

FOREIGN PATENT DOCUMENTS

DE 26 45 671 A1 5/1998

(Continued)

OTHER PUBLICATIONS

Office Action of Jun. 26, 2008 in U.S. Appl. No. 11/600,379.

(Continued)

*Primary Examiner*—Katherine Mitchell
*Assistant Examiner*—Jaime F Cardenas-Garcia
(74) *Attorney, Agent, or Firm*—Renner Kenner Greive Bobak Taylor & Weber

(57) ABSTRACT

A door system (20) having a door (21) movable between a closed position and an open position, a plurality of panels (40-43; 140-143; 240-243), a facer (45; 145; 245) generally defining the configuration of the panels, hinges (50; 150; 250) joining adjacent of the panels for articulation in moving between the closed position and the open position, a reinforcing member (65; 165; 265) associated with the facer extending substantially the longitudinal length of at least one of the panels, a roller assembly (80; 180; 280) mounted on the reinforcing member, and a track system (31, 32; 131, 132; 231, 232) operatively interrelated with the roller assembly, whereby forces imparted to the facer are transferred to the track system through the reinforcing member and the roller assembly.

7 Claims, 10 Drawing Sheets

U.S. PATENT DOCUMENTS

| | | | | |
|---|---|---|---|---|
| 5,495,640 | A * | 3/1996 | Mullet et al. | 16/97 |
| 5,522,446 | A * | 6/1996 | Mullet et al. | 160/229.1 |
| 5,555,923 | A | 9/1996 | Leist et al. | 160/229.1 |
| 5,562,141 | A | 10/1996 | Mullet et al. | 160/232 |
| 5,564,164 | A | 10/1996 | Jella | 16/355 |
| 5,718,276 | A | 2/1998 | Rekret | 160/201 |
| 5,749,407 | A * | 5/1998 | Brenner et al. | 160/229.1 |
| 5,857,510 | A | 1/1999 | Krupke et al. | 160/201 |
| 5,934,352 | A | 8/1999 | Morgan | 160/201 |
| 6,062,293 | A * | 5/2000 | Berger, Jr. | 160/229.1 |
| 6,112,799 | A * | 9/2000 | Mullet et al. | 160/201 |
| 6,161,606 | A | 12/2000 | Wegner et al. | 160/229.1 |
| 6,250,361 | B1 * | 6/2001 | Ochoa | 160/201 |
| 6,328,091 | B1 | 12/2001 | Whitley | 160/201 |
| 6,330,901 | B1 | 12/2001 | Friesen et al. | 160/201 |
| 6,374,567 | B1 | 4/2002 | Mullet | 52/716.1 |
| 6,397,919 | B1 | 6/2002 | Lamsfuss | 160/201 |
| 6,463,988 | B1 * | 10/2002 | Mullet et al. | 160/201 |
| 6,615,898 | B2 * | 9/2003 | Schulte | 160/201 |
| 6,629,387 | B2 * | 10/2003 | Whitley et al. | 52/64 |
| 6,635,218 | B2 | 10/2003 | King | 264/536 |
| 6,655,442 | B2 * | 12/2003 | Snyder | 160/201 |
| 6,679,310 | B2 | 1/2004 | De Zen | 160/229.1 |
| 6,712,117 | B2 | 3/2004 | Jella | 160/229.1 |
| 6,408,926 | B1 | 6/2006 | Hoofard et al. | 160/236 |
| 7,055,573 | B2 * | 6/2006 | Martin | 160/201 |
| 7,299,853 | B2 | 11/2007 | Brown et al. | 160/201 |
| 2003/0230390 | A1 * | 12/2003 | Martin | 160/201 |
| 2006/0201639 | A1 * | 9/2006 | Ostrovsky et al. | 160/201 |

FOREIGN PATENT DOCUMENTS

| | | | |
|---|---|---|---|
| GB | 2 318 819 | A | 5/1998 |
| WO | WO 97/02401 | | 1/1997 |
| WO | WO 2004/009929 | A1 | 1/2004 |

OTHER PUBLICATIONS

Office Action of Oct. 3, 2008 in U.S. Appl. No. 11/600,379.
Office Action of Apr. 1, 2009 in U.S. Appl. No. 11/600,379.
Office Action of Aug. 24, 2009 in U.S. Appl. No. 11/600,379.
Office Action of Feb. 4, 2010 in U.S. Appl. No. 11/600,379.
Office response as filed Jul. 25, 2008 in U.S. Appl. No. 11/600,379.
Office response as filed Dec. 23, 2008 in U.S. Appl. No. 11/600,379.
Office response as filed Jul. 1, 2009 in U.S. Appl. No. 11/600,379.
Office response as filed Nov. 24, 2009 in U.S. Appl. No. 11/600,379.

* cited by examiner

WIND RESISTANT MOVABLE BARRIER

TECHNICAL FIELD

The present invention relates generally to the reinforcement of movable barriers. More particularly, the present invention relates, for example, to upwardly acting sectional doors with improved structure to resist high wind pressures and forces imparted by airborne debris on the facer of the door panels during high velocity wind events. More specifically, the present invention relates to upwardly acting sectional doors having panels with longitudinal reinforcing members that have roller assemblies integrally attached thereto for transmitting forces imparted to the reinforcing members through the roller assemblies and guide tracks to the building structure.

BACKGROUND ART

Due to the recent increasing incidence of severe weather conditions where high winds with entrained debris have caused widespread catastrophic damage to residential and commercial structures, there has recently been greater awareness that upwardly acting door systems, if strengthened, can prevent or reduce damage to the structures. This can have the effect of greater safety for occupants of the structure, as well as providing an avenue of escape from the structure, if necessary. In recognition, building code officials, insurance company interests and public experience and awareness are dictating the development of door systems with improved wind load characteristics.

One type of reinforcement for sectional doors are termed "active" systems that involve reinforcement that is added to a door system prior to a storm and removed after the storm. Such systems normally take the form of a plurality of relatively substantial vertical reinforcing posts that divide the horizontal span of the door into reinforced areas with increased rigidity. The reinforcing posts are normally placed adjacent the inside surface of a door and transfer forces to the floor and the header above the door. Problems are frequently encountered, particularly in retrofitting these systems, because in many instances garage door headers are not structurally designed to accommodate stresses of the magnitude that may be imparted. Similarly, the bottom of the post must be firmly attached to the floor. If not properly designed the forces at the bottom of the post can result in cracking of the foundation slab or pilings in a dirt floor. Some types of floor anchoring structure protrude above the surface of the floor and may become a potentially dangerous obstruction. Further, these systems have the disadvantage that they cannot be considered an avenue of escape in an emergency, inasmuch as substantial disassembly of the parts is normally necessary to render the door operable for upward movement.

Another type of reinforcement for sectional doors are termed "passive" systems that involve reinforcement that is permanently built into the door section and therefore does not require any installation of reinforcing members or other preparation prior to a storm. A disadvantage of this type of system is that the reinforcing members impart additional sprung weight to the door that requires additional strength in the track system, attachment brackets, counterbalance springs and other components. Moreover, these systems add additional wear and tear on motor operators, or require larger motor operators, because of the inertia of starting and stopping a heavier door. As a result, recent efforts have been directed toward reinforcing structure that adds a maximum windload velocity pressure resistance per pound of additional weight.

Early examples of "passive" systems employed one or more wooden beams extending longitudinally of and attached to each of the panels of a sectional door. Later, steel reinforcing elements similarly positioned and attached were employed in various configurations such as "A", "Z", and "J" shaped struts and "C" and "U" shaped channels. However, unless the guide rollers and end stiles to which the reinforcing elements are attached are significantly strengthened, the same early failures tend to occur. Characteristically this manifests itself in the form of distortion or failure of the end stiles often rendering the door inoperative. Thus, the weight of a door may double in order to increase the windload velocity pressure resistance by as little as three to four times.

Another approach to a "passive" system contemplates limiting axial movement of the roller shafts by restraining members thereon, whereby the roller shafts and the panels are tension loaded when the door is in the closed position to prevent buckling of the panels under applied wind loads. The restraining members may be replaced or supplemented with tension rod assemblies. Both the roller shafts and the tension rod assemblies are attached to the hinges that are affixed to the end stiles.

DISCLOSURE OF THE INVENTION

Accordingly, an object of the present invention is to provide a wind resistant upwardly acting sectional door wherein the door panels have reinforcing or strengthening members extending longitudinally thereof and the roller carriers mounting the guide rollers are attached to and supported by the reinforcing or strengthening members. Another object of the present invention is to provide such a door wherein the reinforcing or strengthening elements extending longitudinally of the panels spread external loads on the panel facer, such as windloads and impacts from flying debris, along the length of the reinforcing elements. A further object of the present invention is to provide such a door wherein the reinforcing members are formed integrally with or attached such as to become integral with the door panels and wherein the roller carriers are attached in a manner such as to become integral with the reinforcing members. Yet another object of the present invention is to provide such a door wherein the reinforcing members to which the roller carriers are directly attached do not deflect, twist, or roll over when stressed by windload forces, as end stiles are inclined to do when a component of the load transfer path.

Another object of the present invention is to provide a wind resistant upwardly acting sectional door wherein the same hinge configuration is employed at the ends of the panels and at medial locations so that a separate more complex hinge and roller carrier is not required at the ends of the panels. Yet another object of the present invention is to provide such a door that does not require double roller carriers or double wide roller carriers at the ends of the panels to prevent the rollers from becoming dislodged from the track system during stressing by windload forces. A further object of the present invention is to provide such a door wherein reinforcing members of different steel gauges to achieve varying windload ratings can be employed without necessitating the change of other door hardware because the roller assemblies are directly attached to the struts.

A further object of the invention is to provide a wind resistant upwardly acting sectional door wherein the improved resistance to windload forces may permit use of panels with fewer struts. A still further object of the present invention is to provide such a door wherein thinner, lighter weight panel facer and style materials be employed as these elements do not participate in the transfer of stresses caused by windload from the door to the track and underlying building structure. A still further object of the present invention is to provide such a door wherein the use of thinner gauge materials allows for the use of smaller less expensive counterbalancing components, less powerful motor operators and reduces dead load stress on the horizontal track sections when the door is in the open position.

Yet another object of the present invention is to provide such a door which is faster and simpler to install than other wind resistant doors and due to its lighter weight can be installed onsite by a single person. A further object of the present invention is to provide such a door wherein improved windload capability is proportionately greater than the weight of the added reinforcing elements. A still further object of the invention is to provide such a door wherein windload resistance in velocity pressure may increase from six to eight times with the additional weight of the reinforcing elements adding only 40 to 75 percent of the original sprung weight of the door without the reinforcing elements.

In general, the present invention contemplates a door system having a door movable between a closed position and an open position, a plurality of panels, a facer generally defining the configuration of the panels, hinges joining adjacent of the panels for articulation in moving between the closed position and the open position, a reinforcing member associated with the facer extending substantially the longitudinal length of at least one of the panels, a roller assembly mounted on the reinforcing member, and a track system operatively interrelated with the roller assembly, whereby forces imparted to the facer are transferred to the track system through the reinforcing member and the roller assembly.

BEST MODE FOR CARRYING OUT THE INVENTION

Figure 1:
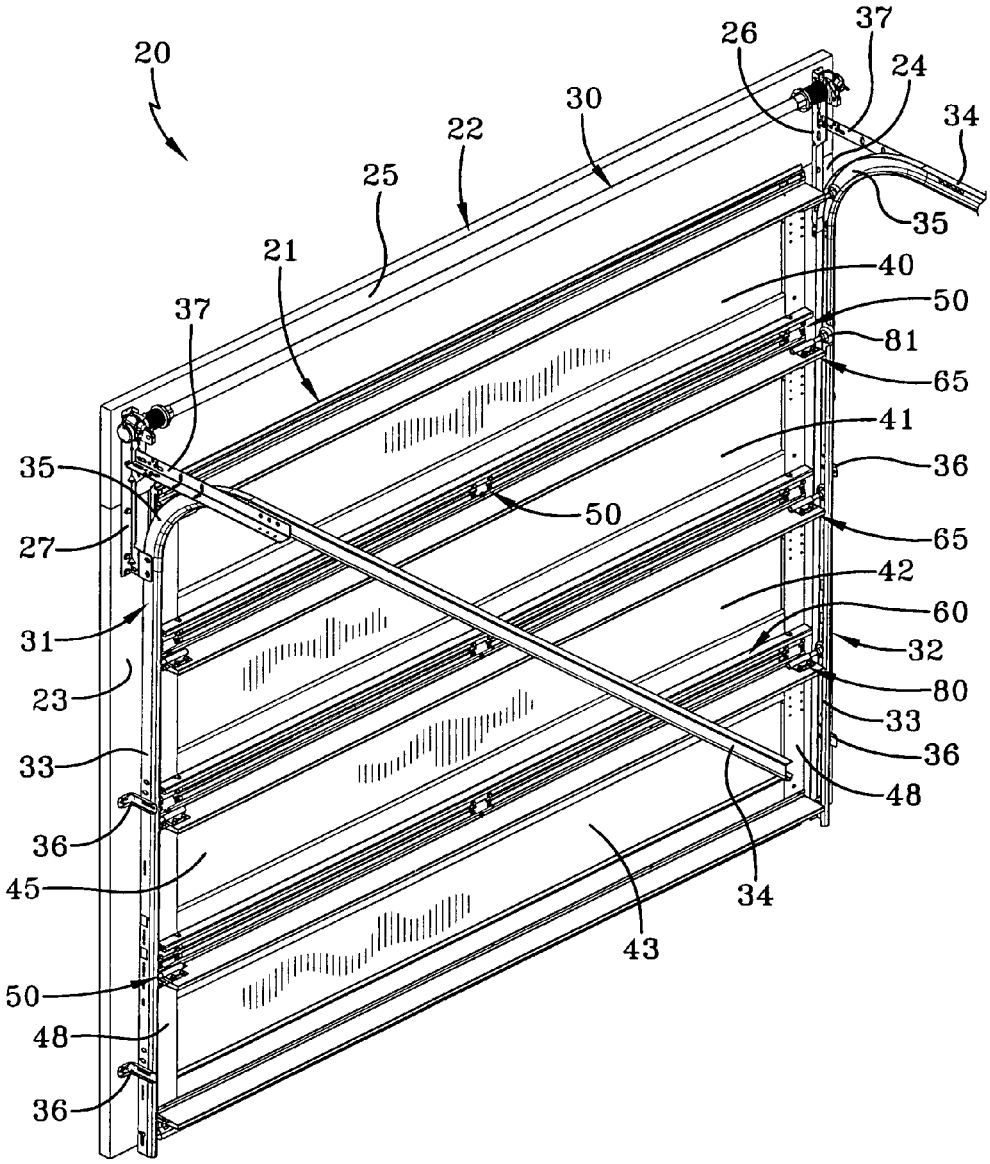
FIG. 1 is a rear perspective view of an upwardly acting sectional door mounted on a door jamb incorporating exemplary strut mounted roller carriers according to the concepts of the present invention.

An exemplary wind resistant upwardly acting sectional door system according to the concepts of the present invention is generally indicated by the numeral 20 in FIG. 1 of the drawings. The wind resistant door system 20 is shown mounted in conjunction with a sectional overhead door, generally indicated by the numeral 21, of a type employed in garages for homes. It will be appreciated, however, that the wind resistant door system 20 can readily be adapted for use in a wide variety of residential and commercial door applications.

The opening in which the door 21 is positioned for opening and closing movement in conventional fashion is defined by a frame, generally indicated by the numeral 22. The frame 22 consists of a pair of spaced jamb members 23 and 24 that, as seen in FIG. 1, are generally parallel and extend vertically upwardly from the floor of a building (not shown). The jambs 23, 24 are spaced and joined proximate their vertical upper extremity by a header 25 to define the generally inverted U-shaped frame 22 for sectional door 21. Frame 22 is normally constructed of lumber, in a manner well known to persons skilled in the art, for purposes of reinforcement, attachment to the building structure, and to facilitate the attachments of elements involved in supporting and controlling sectional door 21.

Affixed to the frame 22 proximate the upper extremity thereof and to either side of the door 21 are flag angles 26 and 27. The flag angles are attached to underlying jamb members 23 and 24 and/or header 25 and may be any of a variety of known configurations employed in the art. As shown in FIG. 1, the flag angles 26, 27 may mount a counterbalance system generally indicated by the numeral 30, that interacts with the door 21 to facilitate raising and lowering the door 21. While a counterbalance system according to applicants assignee's U.S. Pat. No. 5,419,010 is shown for exemplary purposes in FIG. 1 it will be appreciated that any of a variety of different types of counterbalancing systems may be employed.

The flag angles 26, 27 also partially support a roller track system, generally indicated by the numerals 31 and 32, each including a vertical track section 33, a horizontal track section 34 and a transition track section 35 interposed therebetween. The roller tracks 31, 32 support and direct travel of sectional door 21 in moving from the closed, vertical position depicted in FIG. 1 associated with the vertical track sections 33, 33 to the open horizontal position associated with horizontal track sections 34, 34. In addition to flag angles 26, 27, a plurality of brackets 36 rigidly attach the vertical track sections 33, 33 to the door jambs 23, 24. The vertical track sections 33 are advantageously slightly outwardly inclined from the jambs 23, 24 in order to seat the door relative to the frame 22 in the closed position while opening a space between the door 21 and jambs 23, 24 upon the commencement of door opening to reduce possible binding between the door 21 and jambs 23, 24 during initial stages of movement of the door from the closed vertical position to the open horizontal position. Horizontal angles 37 may interconnect the flag angles 26, 27 and the horizontal track sections 34 to lend support to the horizontal track sections 34.

Figure 2:
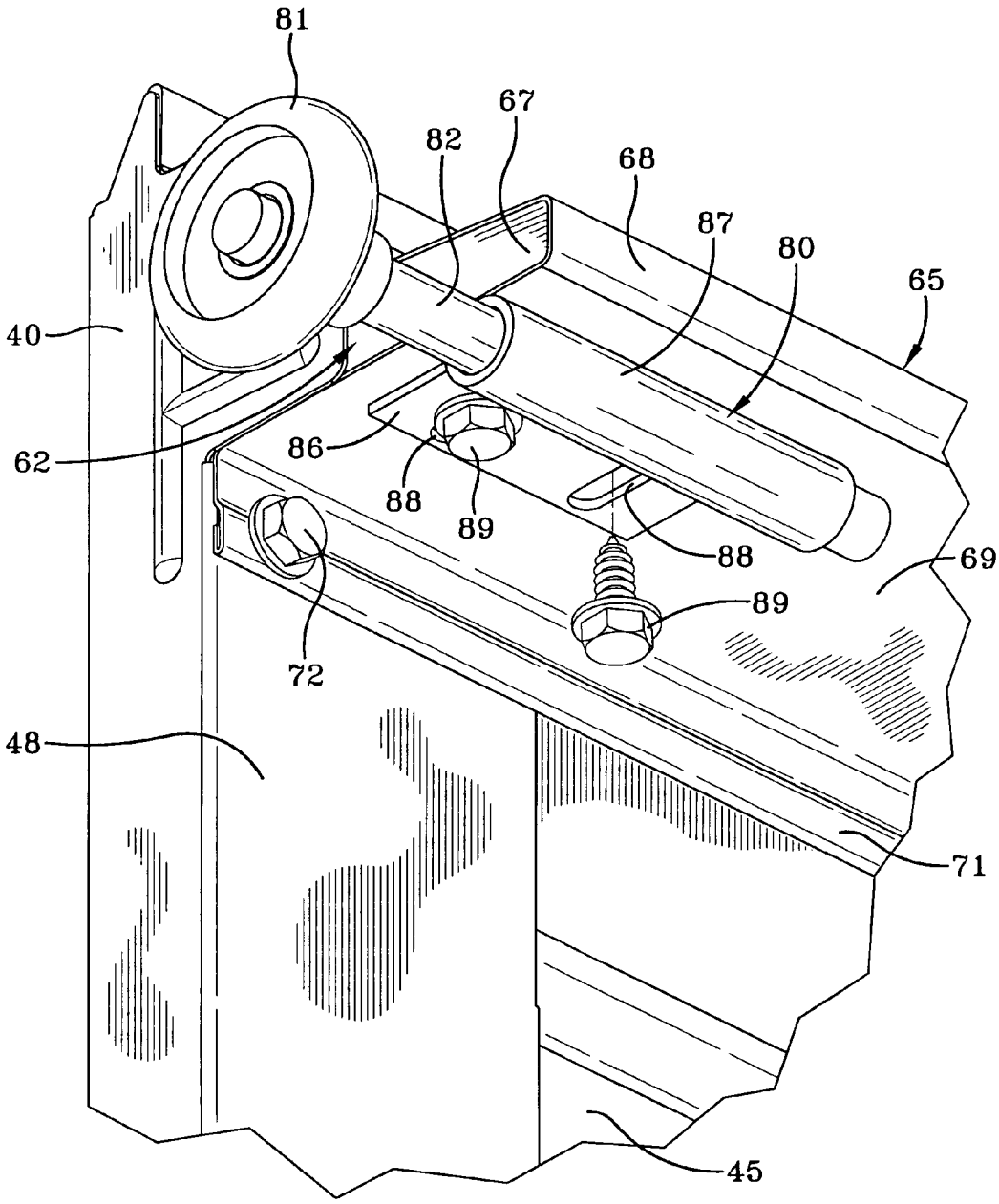
FIG. 2 is an enlarged fragmentary perspective view showing details of a roller carrier mounted at the left end of the top strut of the top panel of the sectional door as depicted in FIG. 1.
Figure 3:
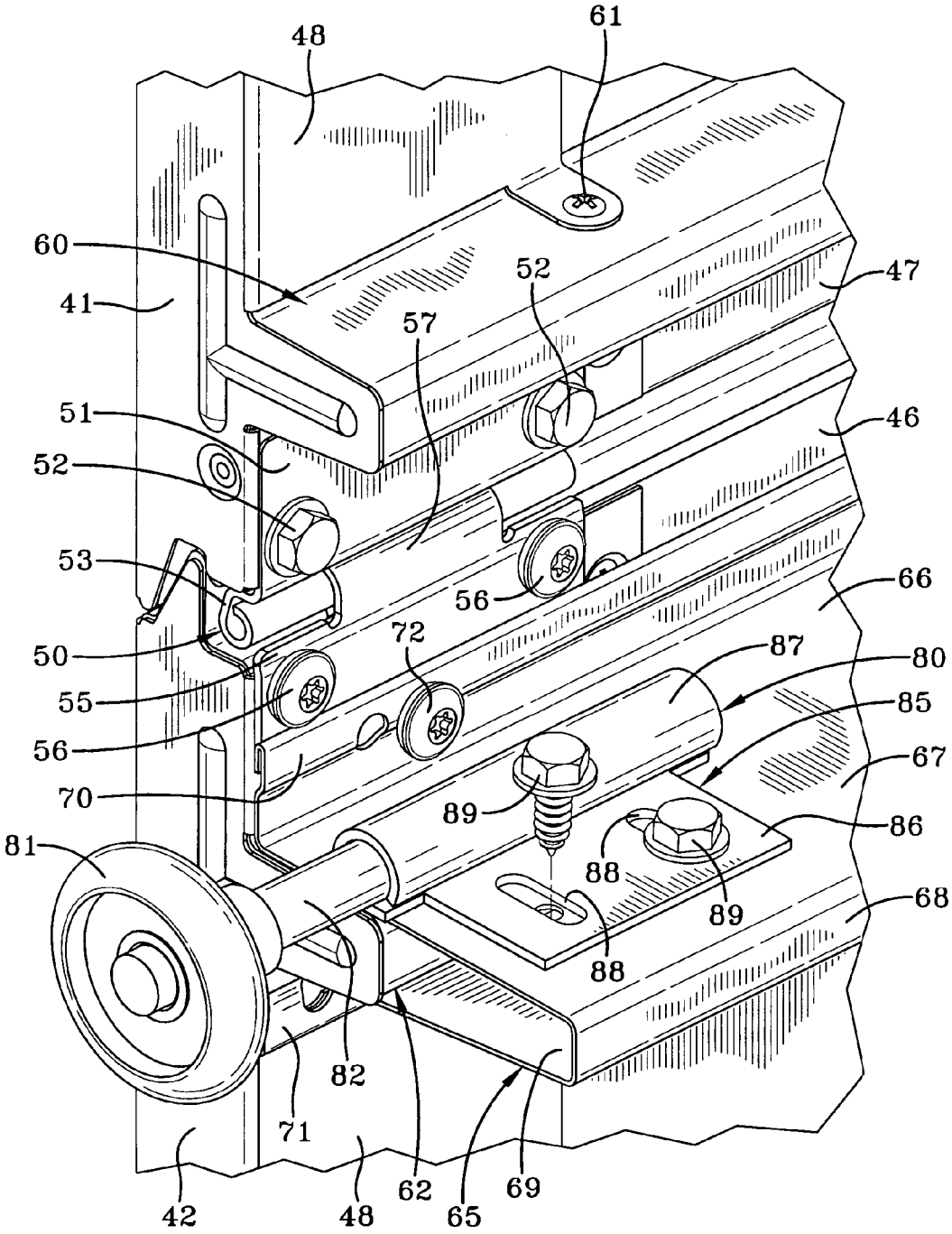
FIG. 3 is an enlarged fragmentary top perspective view of a roller carrier mounted at the left end of each top strut of the upper middle panel, lower middle panel and bottom panel of the sectional door of FIG. 1.
Figure 4:
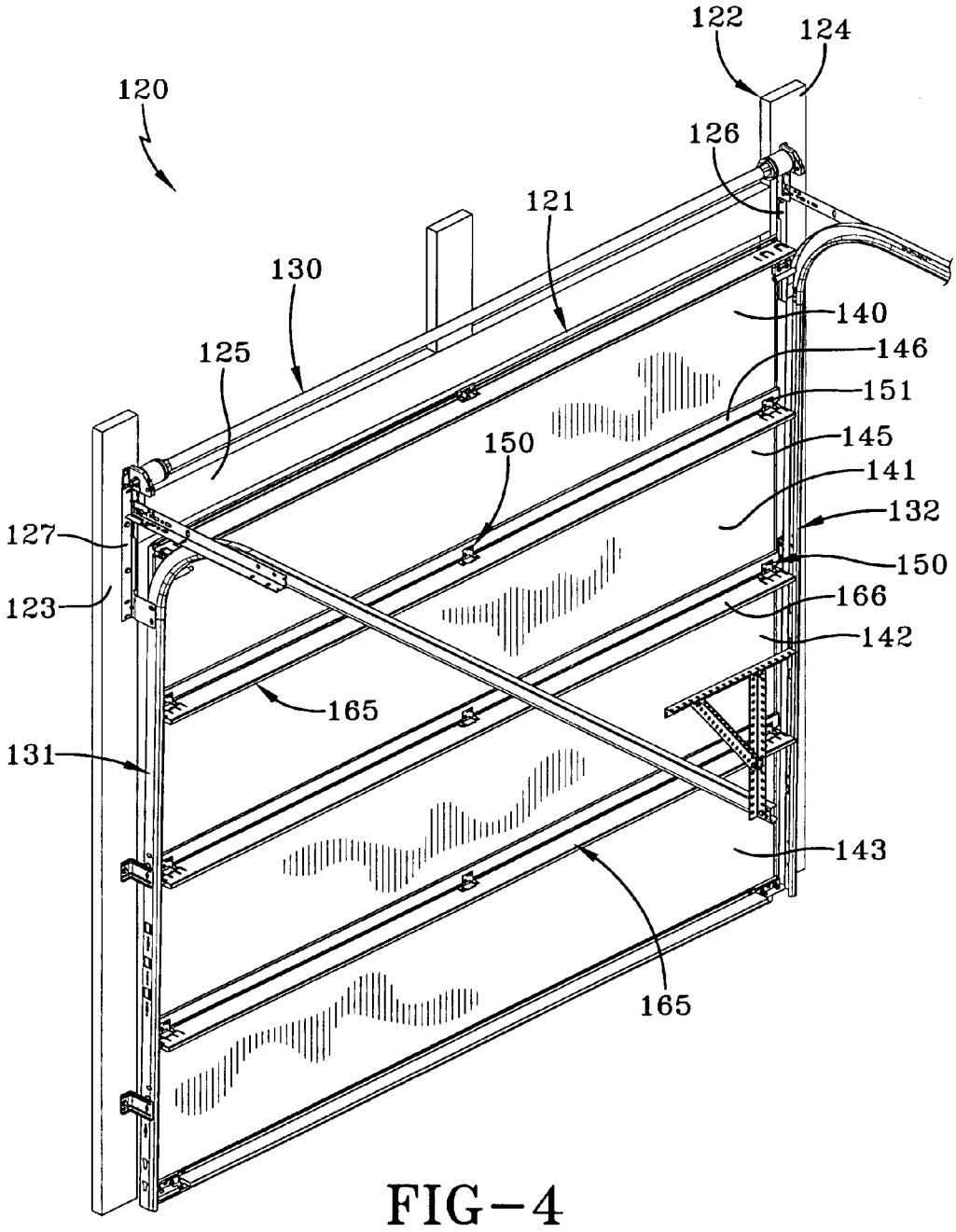
FIG. 4 is a rear perspective view of an upwardly acting sectional door mounted on a door jamb incorporating a first alternate embodiment of strut mounted roller carriers according to the concepts of the present invention.

While a four panel sectional door 21 is depicted in the drawings, it is to be appreciated that more or less panels may be employed in sectional doors of this type, depending upon the height of the door opening and related considerations. As depicted, the sectional door 21 consists of a top panel 40, an upper middle panel 41, a lower middle panel 42 and a bottom panel 43. Referring to FIGS. 1-3 of the drawings, each of the panels 40-43 may have the same configuration, including a skin forming a facer 45 with a rearwardly extending upper rail 46 and a lower rail 47 that may assume differing configurations. As shown, the panels 40-43 are provided with end stiles 48 at each longitudinal end.

Adjacent panels 40-43 are interconnected at their lateral edges by hinge assemblies, generally indicated by the numeral 50. Hinge assemblies 50 are located at the longitudinal ends of the panels and may be provided with one or more intermediate hinge assemblies 50 (FIG. 1) depending upon the longitudinal length of panels 40-43 and other considerations. Inasmuch as the hinge assemblies 50 may advantageously all be of an identical configuration, only one is detailed as exemplary in FIG. 3 of the drawings.

As seen particularly in FIG. 3, the hinge assemblies 50 each have a top leaf 51 mounted proximate the lower edge of each of panels 40-42. Each top leaf 51 is attached at end style 48 and/or lower rail 47 as by fasteners 52, which may be screws, bolts, rivets, or other fasteners, depending upon the material of facer 45 and end stiles 48. The top leaf 51 has cylindrical knuckles 53 projecting downwardly toward an adjacent lower panel of the panels 41-43. The hinge assemblies 50 also have a bottom leaf 55 mounted proximate the upper edge of each of the panels 41-43. Each bottom leaf 55 is attached at end stile 48 and/or upper rail 46, as by fasteners 56 comparable to fasteners 52. Each bottom leaf 55 has a projecting knuckle 57 that is attached to and freely pivotal engages knuckle 53 of top leaf 51. As constituted, the hinge assemblies 50 do not require a hinge pin due to the configuration of knuckles 53 and 57. The hinge assemblies 50 may be installed on the panels 40-43 during the in-the-field assembly or the bottom leaf 55 of the hinge assembly 50 may be attached during the manufacturing process before leaving the factory and the top leaf 51 of the hinge assembly 50 attached during in-the-field assembly.

In the embodiment of FIGS. 1-3 of the drawings the door panels 40-43 have bottom positioning ribs, generally indicated by the numeral 60, that are reinforcing members preferably located proximate to the lower edge of each of the panels 40-43. The bottom positioning ribs 60 shown are integrally formed with facer 45. The end stiles 48 and/or lower rails 47 of panels 40-43 may be attached to bottom positioning ribs 60 as by the fasteners 61. The positioning ribs 60 interrelate with the end stiles 48 and facer 45 such as to distribute wind and other forces imparted to the facer. The door panels 40-43 also have top positioning ribs, generally indicated by the numeral 62, that are similar to the positioning ribs 60 but located proximate to the upper edge of each of the panels 40-43. The panels 40-43 as thus far described may be substantially in accordance with applicants assignee's U.S. Pat. No. 5,522,446.

The panels 40-43 have top struts, generally indicated by the numeral 65, that are reinforcing members preferably located proximate to the upper edges of the panels 40-43. Struts are known in the sectional door industry as horizontally extending support stiffeners employed on door panels to reduce deflection of the panels, which definition is adopted for purposes of the present application. As shown, the top struts 65 have a generally hollow U-shaped body 66 consisting of a top leg 67, a back leg 68 and a bottom leg 69. Projecting flanges 70 and 71 extend from the top leg 67 and the bottom leg 69, respectively, and may straddle the top positioning ribs 62. The flanges 70, 71 are attached to the end style 48 and/or upper rail 46 as by a plurality of fasteners 72. Advantageously, a fastener 72 may be positioned in projecting flange 70 at a location such as to be anchored into bottom leaf 55 of hinge assembly 50. Top struts 65 are thus affixed to the panels 40-43 such as to operate integrally with the facer 45 to distribute wind and other forces that impinge upon the facers 45. The top struts 65 may be made in various versions having differing material thickness and design constitution in order to meet differing windload requirements. In some applications, the top struts 65 could be formed integrally with the facer 45.

The door panels 40-43 interrelate with the roller tracks 31, 32 by virtue of roller assemblies, generally indicated by the numeral 80 in FIGS. 1-3 of the drawings. As shown, the roller assemblies 80 include a roller 81 which is adapted to engage tracks 31 and 32 in a conventional fashion. Rollers 81 may be a combination unit with an attached roller shaft 82. The roller shaft 82 is a elongate cylindrical member that is positioned and supported by a roller carrier, generally indicated by the numeral 85. Roller carrier 85 includes a mounting plate 86 and an integrally formed cylindrical sleeve 87. The cylindrical sleeve 87 receives the roller shaft 82 and is sized to permit movement of roller shaft 82 axially with respect to the cylindrical sleeve 87.

As shown, a roller assembly 80 is mounted on each end of each of the top struts 65 and exteriorly thereof to thus interrelate the struts with roller tracks 31 and 32. In this respect the mounting plate 86 of roller carrier 85 is positioned exteriorly of and on a top leg 67 or bottom leg 69 of top struts 65. As shown each mounting plate 86 has a pair of apertures 88 that receive suitable fasteners 89 that penetrate the top struts 65. As shown, the apertures 88 are elongate slots oriented substantially perpendicular to the plane of the facer 45 to thus permit selective adjustment of the position of roller 81 relative to the facer 45. Roller assemblies 80 are thus adjustably mounted to permit adjustment for sealing closure of the door 21 relative to the jamb members 23, 24, taking into account the outward inclination of tracks 31, 32 relative to jamb members 23, 24 from bottom to top. The fasteners 89 are tightened at an appropriate position so that roller assemblies 80 are rigidly attached to top struts 65, such as to be essentially integral therewith and thus transfer forces from the top struts 65 to roller assemblies 80 to the tracks 31, 32 and thus to the jambs 23, 24. As can be seen in FIGS. 2 and 3 the roller assemblies 80 may be positioned on the bottom leg 69 of top strut 65 in the case of the top panel 40 and on the top leg 67 top struts 65 in the case of the remaining panels 41-43. Depending on positioning of the top struts 65 and their configuration, the roller assemblies 80 are designed and mounted in a manner to position the rollers 81 in an acceptable position to permit smooth articulation of panels 40-43 about the hinge assemblies 50.

A first alternate embodiment of a wind resistant upwardly acting sectional door system according to the concepts of the present invention is generally indicated by the numeral 120 in FIGS. 4-7 of the drawings. The wind resistant door system 120 is shown mounted in conjunction with a sectional overhead door, generally indicated by the numeral 121, that is a different configuration than door system 20 but of a type commonly employed in garages for homes.

The opening in which the door 121 is positioned for opening and closing movement is defined by a frame, generally indicated by the numeral 122, that may have the same characteristics as the frame 22 described hereinabove. In that respect, the frame 122 consists of jamb members 123 and 124 joined by a header 125. The door system 120 also includes flag angles 126 and 127 that are similar to flag angles 26 and 27 and are attached to the underlying jamb members 123, 124 and/or header 25. The flag angles 126, 127 also mount a counterbalance system 130 which may be the same as the counterbalance system 30. The door system 120 also has roller tracks, generally indicated by the numerals 131 and 132 that are mounted and operate in the manner detailed hereinabove.

The sectional door 121 is depicted as having four panels, namely, a top panel 140, an upper middle panel 141, a lower middle panel 142, and a bottom panel 143. Referring to FIGS. 4-7 of the drawings, each of the panels 140-143 may have the same configuration, including a skin forming a facer 145 with a rearwardly extending upper rail 146 and a lower rail 147 that may assume differing configurations. As shown, the panels 140-143 may be provided with end caps 148 at each longitudinal end.

Adjacent panels 140-143 are interconnected at their lateral edges by hinge assemblies, generally indicated by the numeral 150. Hinge assemblies 150 are located at the longitudinal ends of the panels and may be provided with one or more intermediate hinge assemblies 150 (FIG. 4) depending upon the longitudinal length of panels 140-143 and other considerations. Inasmuch as the hinge assemblies 150 may advantageously all be of an identical configuration, only one is detailed as exemplary in FIGS. 5-7 of the drawings.

As shown, the hinge assemblies 150 each have a top leaf 151 mounted proximate the lower edge of each of panels 140-142. Each top leaf 151 is attached to a lower rail 147 as by fasteners 152 which may be screws, bolts, rivets, or other fasteners, depending upon the material of facer 145. The top leaf 151 has cylindrical knuckles 153 projecting downwardly toward an adjacent lower panel of the panels 141-143. The hinge assemblies 150 also have a bottom leaf 155 mounted proximate the upper edge of each of the panels 141-143. Each bottom leaf 155 is attached to facer 145 above the upper rail 146 as by fasteners 156 comparable to fasteners 152. Each bottom leaf 155 has a projecting knuckle 157 that is attached to and freely pivotally engages knuckle 153 of top leaf 151. The hinge assemblies 150 may be installed on the panels 141-143 during the in-the-field assembly or the bottom leaf 155 of the hinge assembly 150 may be attached during the manufacturing process before leaving the factory and the top leaf 151 of the hinge assembly 150 attached during in-the-field assembly. If the bottom leaf 155 is to be attached during the manufacturing process, a tab 158 may be provided thereon for engaging an aperture 159 in the top leaf 151 to maintain the hinge assembly 150 with top leaf 151 and bottom leaf 155 in the relative position depicted in FIG. 7 of the drawings.

The panels 140-143 have top struts, generally indicated by the numeral 165, that are reinforcing members preferably located proximate to the upper edges of the panels 140-143. As shown, the top struts 165 have a generally hollow U-shaped body 166 consisting of a top leg 167, a back leg 168 and a bottom leg 169. Projecting flanges 170 and 171 extend from the top leg 167 and the bottom leg 169, respectively. The flanges 170, 171 are shown with top leg 167 and bottom leg 169 straddling the upper rail 146 and attached to facer 145 by a plurality of fasteners 172 extending through the flanges 170, 171. The top struts 165 are thus affixed to the panels 140-143 such as to operate integrally with the facer 45 to distribute wind and other forces that impinge upon the facers 145. The top struts 165 are otherwise subject to variations in design characteristics as set forth in regard to the top struts 65.

Figure 5:
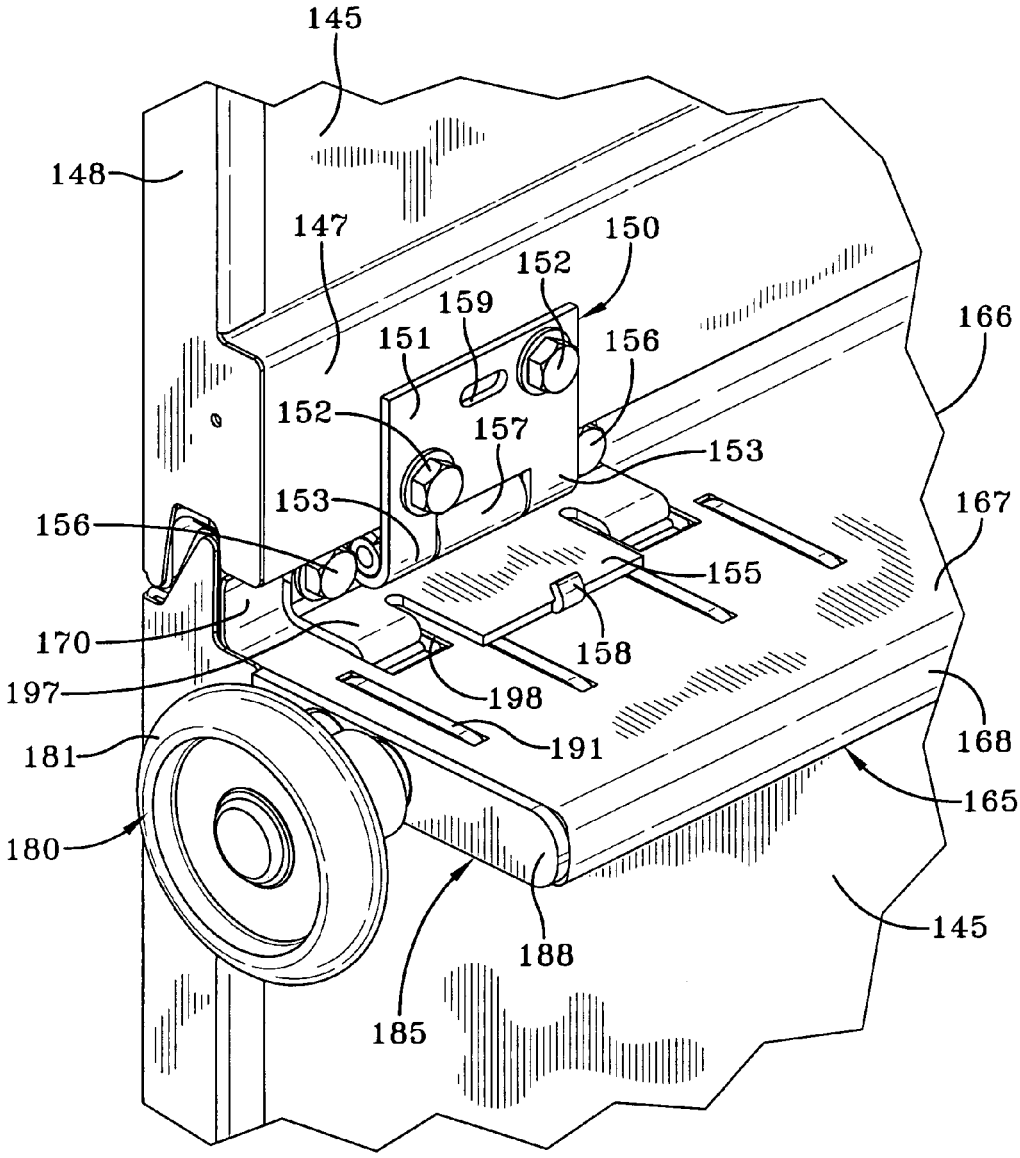
FIG. 5 is an enlarged fragmentary top perspective view of a first alternate roller carrier mounted at the left end of each of the top struts of the upper middle panel, lower middle panel and bottom panel of the sectional door of FIG. 4.
Figure 6:
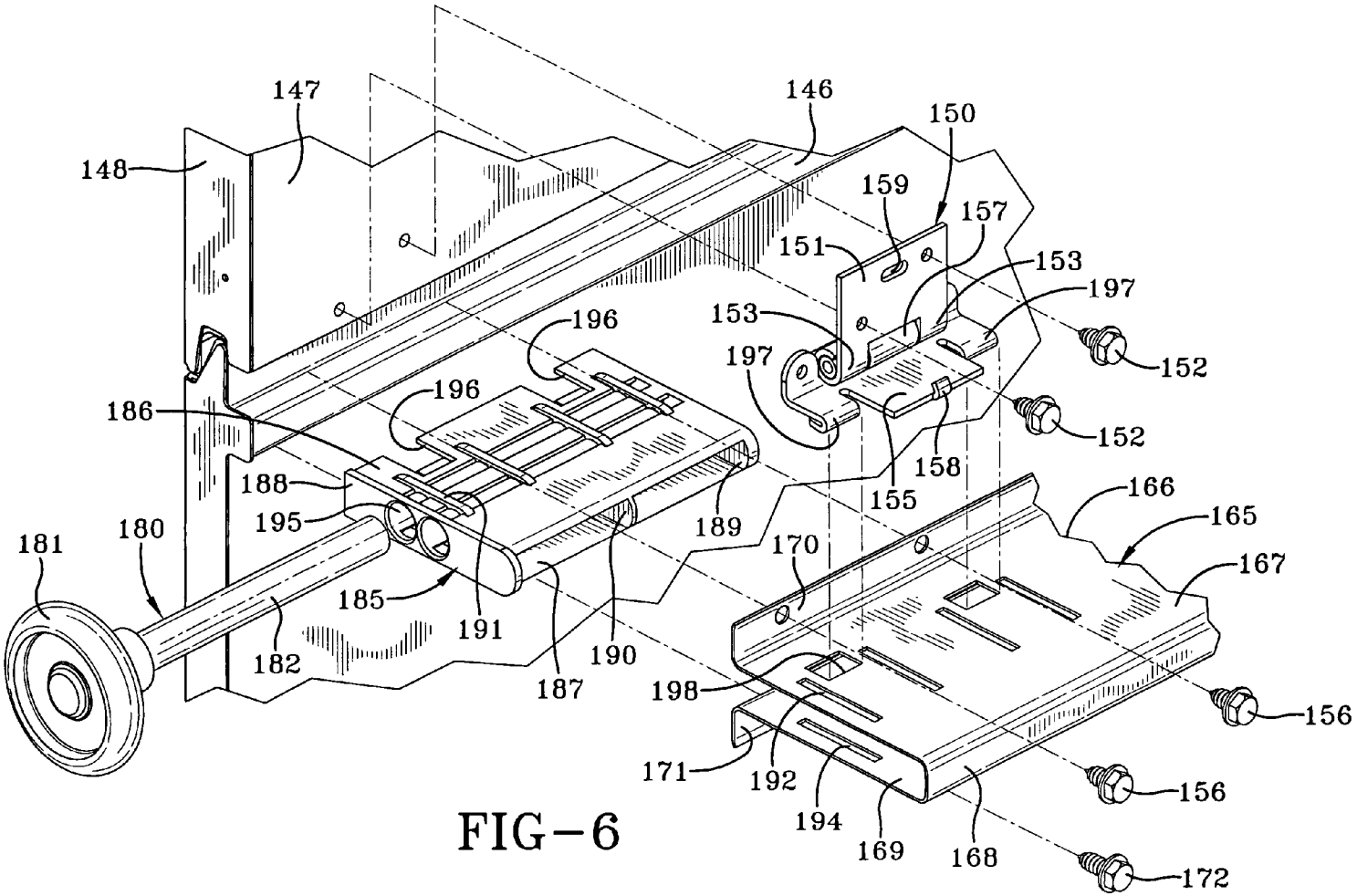
FIG. 6 is an enlarged exploded top perspective view of the first alternate roller carrier of FIG. 6 shown mounted on a strut.
Figure 7:
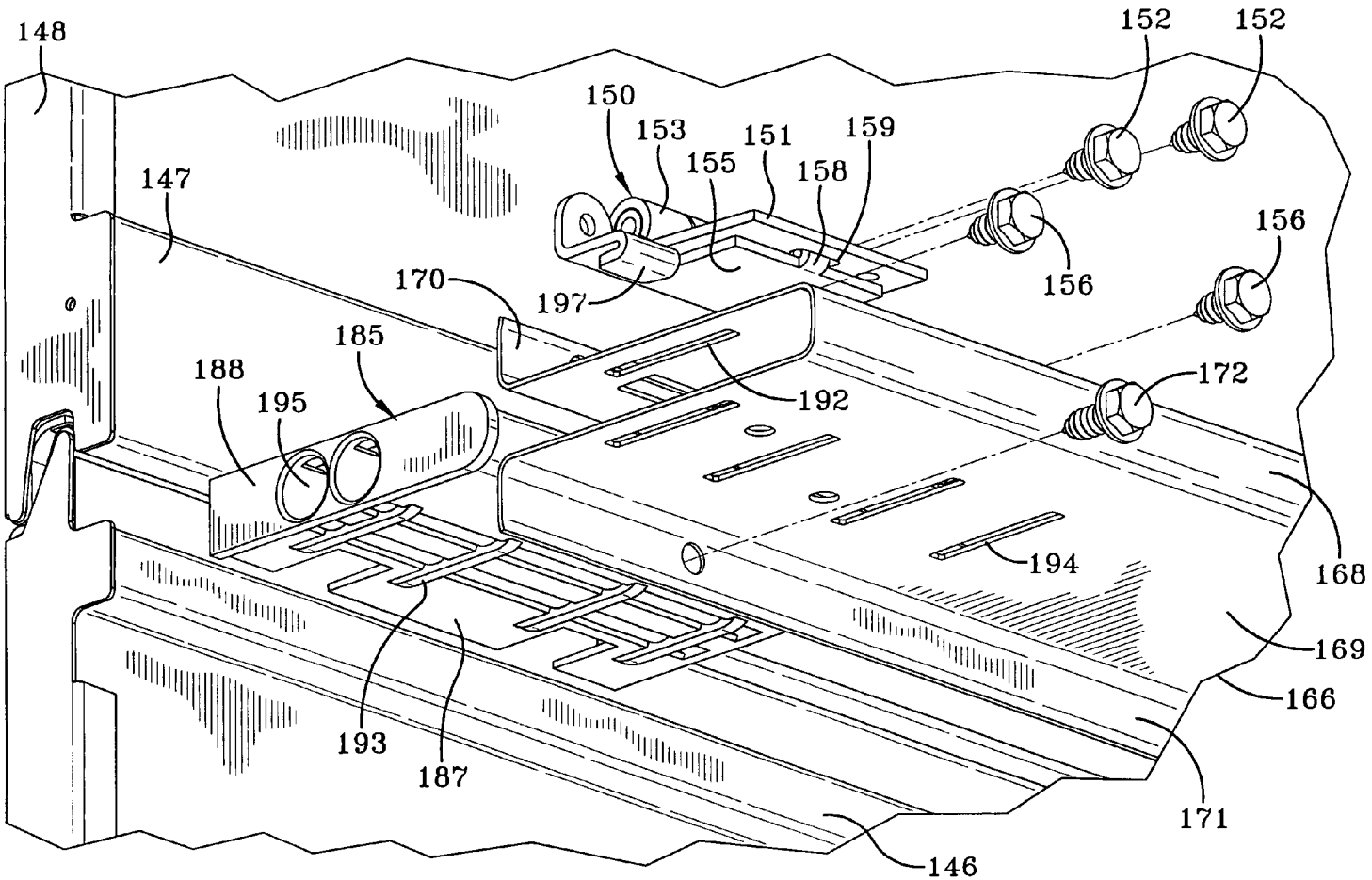
FIG. 7 is an enlarged exploded bottom perspective view of the first alternate roller carrier of FIG. 6 showing details thereof.

The door panels 140-143 interrelate with the roller tracks 131, 132 by virtue of roller assemblies, generally indicated by the numeral 180, in FIGS. 5-7 of the drawings. As shown, the roller assemblies 180 include a roller 181 that is adapted to engage tracks 131 and 132 in a conventional fashion. The rollers 181 may be a combination unit with an attached roller shaft 182 that is an elongate cylindrical member. The roller shaft is positioned and supported by a roller carrier, generally indicated by the numeral 185.

As shown, a roller assembly 180 is mounted on each end of each of the top struts 165 and interiorly thereof to thus interrelate the struts with the roller tracks 31, 32. In this respect the roller carriers 185 have a generally rectangular framework consisting of a generally planer top plate 186 and bottom plate 187. An outer end wall 188, an inner end wall 189, and one or more medial walls 190 space and join the top plate 186 and bottom plate 187, such that they are substantially parallel with and contact the top leg 167 and bottom leg 169 of top struts 165 when roller carrier 185 is inserted into a top strut 165 as depicted in FIG. 5 of the drawings.

The roller carriers 185 are maintained in position and subject to the transfer of forces from top strut 165 by virtue of raised projections 191 in the top plate 186 which matingly engage slots 192 in the top leg 167 of strut 165. While two such raised projections 191 oriented substantially perpendicular to the facer 145 might suffice, four such raised projections 191 and slots 192 are shown in the top plate 186 of roller carrier 185 and the top leg 167 of strut 165. Raised projections 193 may also be advantageously positioned on the bottom plate 187 of roller carrier 185 and similarly matingly engage slots 194 in the bottom leg 169 of the struts 165. A combination of raised projections 191, 193 and an extent of resiliency of the struts 165 allows the roller carriers 185 to be slid into the struts 165 with the raised projections 191, 193 snapping into position in slots 192, 194 to lock the roller carrier 185 in place. This positioning effects the transfer of forces from the struts 165 to the roller carriers 185.

The roller carriers 185 have one or more tubular channels 195 at various positions rearwardly of facer 145 and extending perpendicular to end walls 188 that receive the tubular shaft 182 of rollers 181. With the rollers 181 positioned in tracks 31, 32 and roller shaft 182 in a channel 195 of roller carrier 185 windload and other stresses are thus transferred from the struts 165 to roller assemblies 182 and to the spaced tracks 31, 32. The top plate 186 of roller carriers 185 may have cutaway portions 196 to provide clearance for inturned hooks 197 on bottom leaf 155 of hinge assemblies 150 that project through apertures 198 in the top leg 167 of struts 165 and are attached thereto. This provides further anchoring of the bottom leaf 155 of hinge assemblies 150.

Figure 8:
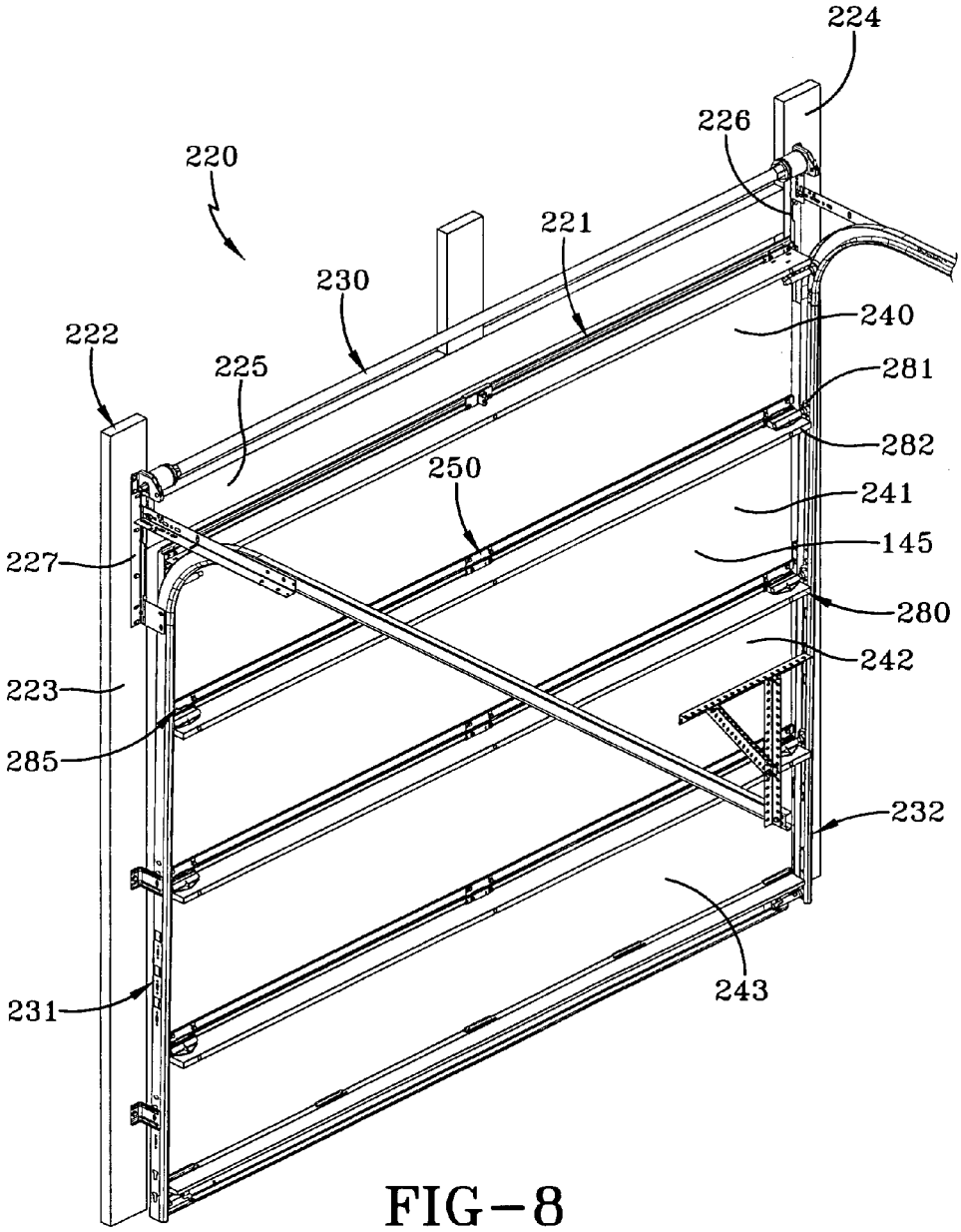
FIG. 8 is a rear perspective view of an upwardly acting sectional door mounted on a doorjamb incorporating a second alternate embodiment of strut mounted roller carriers according to the concepts of the present invention.
Figure 9:
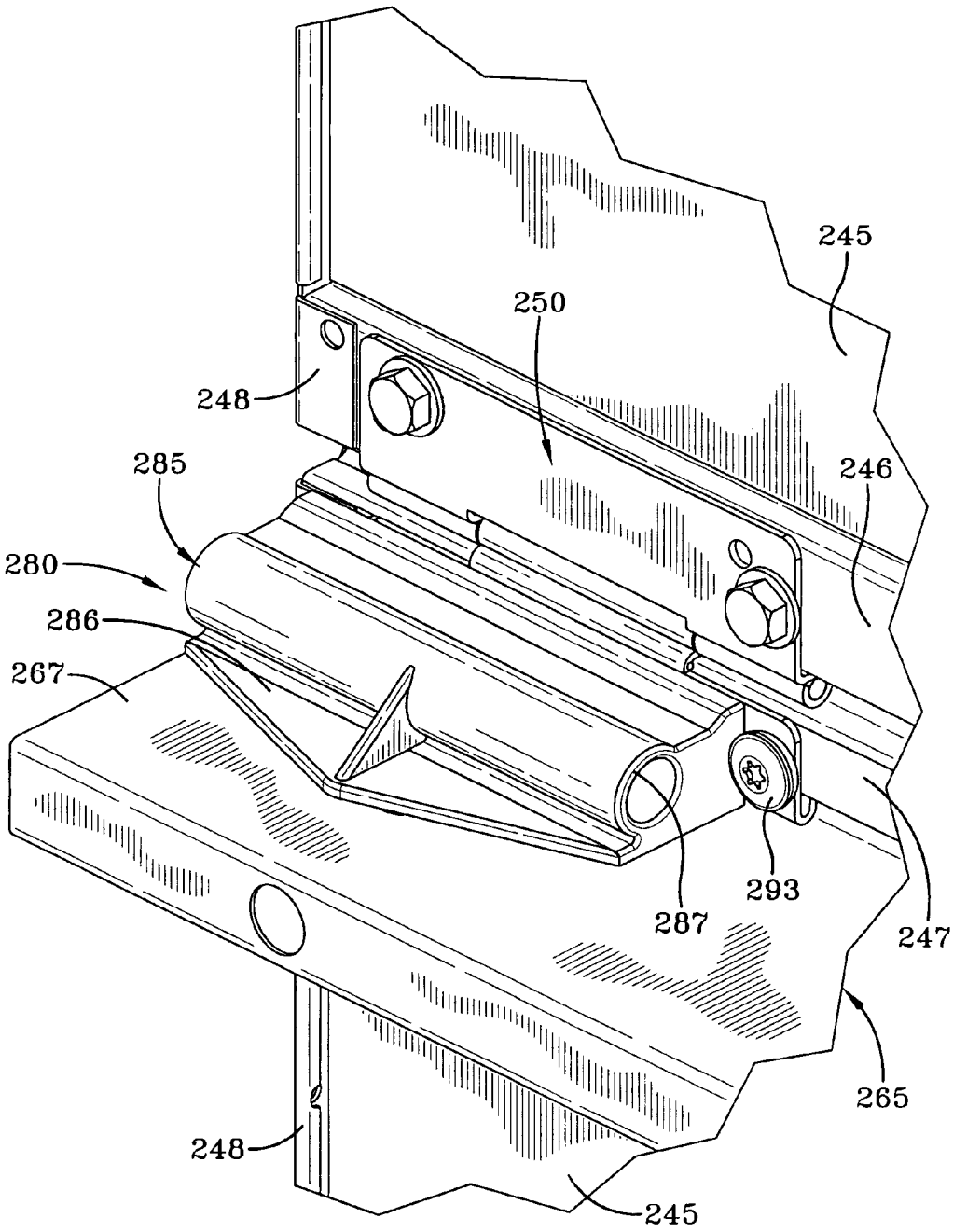
FIG. 9 is an enlarged fragmentary top perspective view of a second alternate roller carrier mounted at the left end of each of the top struts of the upper middle panel, lower middle panel and bottom panel for the sectional door of FIG. 9.
Figure 10:
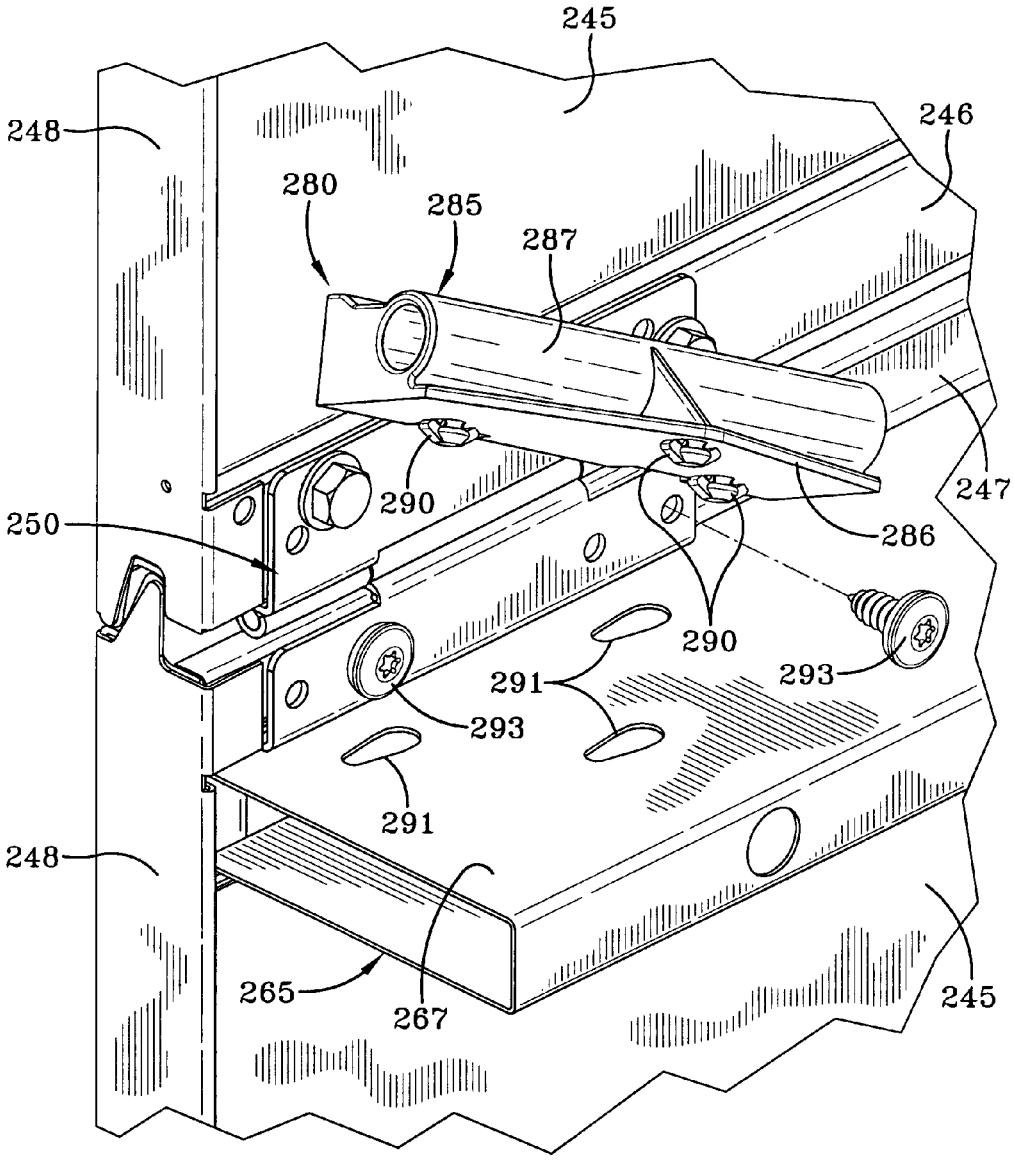
FIG. 10 is an enlarged exploded top perspective view of the second alternate roller carrier of FIG. 9 separated from the strut and rotated through an angle sufficient to show the fastening elements.

A second alternate embodiment of a wind resistant upwardly acting sectional door system according to the concepts of the present invention is generally indicated by the numeral 220 in FIGS. 8-10 of the drawings. The wind resistant door system 220 is shown mounted in conjunction with a sectional overhead door, generally indicated by the numeral 221, of a type commonly employed in garage doors for homes.

The opening in which the door 221 is positioned for opening and closing movement is defined by a frame, generally indicated by the numeral 222, that may have the same characteristics as the frame 22 described hereinabove. In that respect, the frame 222 consists of jamb members 223 and 224 joined by a header 225. The door system 220 also includes flag angles 226 and 227 that are similar to the flag angles 26 and 27 and are attached to the underlying jamb members 223, 224 and/or header 225. The flag angles 226, 227 also mount a counterbalance system 230 which may be the same as the counterbalance system 30. The door system 220 also has roller tracks, generally indicated by the numerals 231 and 232, that are mounted and operated in the manner detailed herein above with respect to roller tracks 31 and 32.

The sectional door 221 is depicted as having four panels, namely, a top panel 240, an upper middle panel 241, a lower middle panel 242 and a bottom panel 243. The panels 240-243 may have a configuration including a skin forming a facer 245 with a rearwardly extending upper rail 246 and lower rail 247. As shown, the panels 240-243 may be provided with end caps 248 at each longitudinal end.

Adjacent panels 240-243 are connected at their lateral edges by hinge assemblies generally indicated by the numeral 250. Hinge assemblies 250 are located at the longitudinal ends of the panels and may be provided with one or more intermediate hinge assemblies 250 (FIG. 8) depending upon the longitudinal length of panels 240-243 and other considerations. Inasmuch as the hinge assemblies 250 may advantageously all be of an identical configuration, only one is depicted as exemplary in FIGS. 9 and 10 of the drawings. The construction of the hinge assemblies 250 may be identical to the hinges 50, as well as their attachment to upper rail 246 and lower rail 247.

The panels 240-243 have top struts, generally indicated by the numeral 265, that may be affixed to the panels 240-243 in the manner of the struts 65. Struts 265 thus operate integrally with the facer 245 to distribute wind and other forces that impinge upon the facers 245.

Door panels 240-243 interrelate with the roller tracks 231, 232 by virtue of roller assemblies generally indicated by the numeral 280 in FIGS. 8-10 of the drawings. As shown, particularly in FIG. 8, the roller assemblies include a roller 281 that is adapted to engage tracks 231, 232 in a conventional fashion. Rollers 281 may be a combination unit with an attached roller shaft 282. The roller shaft 282 is positioned and supported by a roller carrier, generally indicated by the numeral 285. Roller carrier 285 includes a mounting plate 286 and an integrally formed cylindrical sleeve 287. The cylindrical sleeve 287 receives the roller shaft 286 and is sized to permit movement of roller shaft 282 axially with respect to the cylindrical sleeve 287.

As shown, the roller assembly 280 is mounted on the top or bottom of the struts 265 and exteriorly thereof to thus interrelate the struts 265 with the roller tracks 231, 232. Roller carriers 285 differ from the roller carriers 85 primarily in the manner of attachment to the struts 265. As shown, the bottom of mounting plate 286 of roller carrier 285 has a plurality of protecting slide lock tabs 290. As seen, there are three spaced slide lock tabs 290 which are adapted to engage slots 291 in strut 265 (see FIG. 10). The slots 291 are elongated and taper longitudinally of the top leg 267 of the strut 265. In the embodiment depicted in FIG. 10 the slots 291 taper from right to left as viewed in FIG. 10, from a larger opening capable of receiving the slide lock tabs 290 to a lesser dimension which precludes separation of the roller carrier 285 from the strut 265. Thus, once the slide lock tabs 290 are inserted in slots 291 and the roller carrier 285 is moved longitudinally of strut 65 to the left as viewed in FIG. 10, roller carrier 285 reaches a locked position. Once so positioned a fastener 293 may be inserted in hinge assembly 250 proximate to the extremity of roller carrier 285 to prevent movement of roller carrier 285 from the locked position (see FIG. 9). With the roller carrier 285 thus locked in position on strut 265, forces in the strut 265 are transferred through roller carrier 285, roller shaft 282 and roller 281 to adjacent tracks 231, 232.

Thus, it should be evident that the wind resistant movable barrier disclosed herein carries out one or more of the objects of the present invention set forth above and otherwise constitutes an advantageous contribution to the art. As will be apparent to persons skilled in the art, modifications can be made to the embodiments disclosed herein without departing from the spirit of the invention, the scope of the invention herein being limited solely by the scope of the attached claims.

The invention claimed is:

1. A door system comprising, a door movable between a closed position and an open position, a plurality of panels, a facer generally defining the configuration of said panels, a plurality of hinges joining each panel to adjacent panels for articulation in moving between said closed position and said open position, a hollow strut protruding from said facer and extending substantially the longitudinal length of at least one of said panels, said hollow strut having a generally U-shaped body having a top leg and a bottom leg, each said leg having an extending flange attached to said facer, a roller assembly carried by said hollow strut, and a track system operatively interrelated with said roller assembly, wherein said roller assembly is attached to one of said legs without contacting said hinges so that forces imparted to said facer are transferred to said track system through only said hollow strut and said roller assembly, wherein said roller assembly includes a roller carrier and a roller supported by said roller carrier and engaging said track system, and wherein said roller carrier is mounted exteriorly of said hollow strut.

2. A door system according to claim 1, further comprising:

a rib extending from said facer, said legs extending in a same direction as said rib, wherein said roller carrier is mounted on one of said legs of said hollow strut.

3. A door system according to claim 2, wherein said roller carrier has a mounting plate for engaging said leg and apertures;

said door system further comprising fasteners for rigid attachment of said mounting plate to said leg.

4. A door system according to claim 3, wherein said apertures are horizontally extending elongate slots for selectively adjustably positioning said roller carrier relative to said facer and said track system.

5. A door system comprising, 1, further comprising:

a door movable between a closed position and an open position, a plurality of panels, a facer generally defining the configuration of said panels, longitudinally spaced hinges joining adjacent of said panels for articulation in moving between said closed position and said open position, a hollow strut attached to and protruding from said facer and extending substantially the longitudinal length of at least one of said panels, said hollow strut having a generally U-shaped body having a top leg and a bottom leg, each said leg having an extending flange attached to said facer, a roller carrier carried by said hollow strut, a roller supported by said roller carrier, and a roller track receiving said roller to control movement of said door between the closed position and the open position, wherein said roller carrier is connected only to one of said legs so that forces imparted to said facer are transferred to said roller track through only said hollow strut, said roller carrier and said roller, wherein a roller shaft carries said roller and said roller shaft is positioned and supported by said roller carrier, and wherein said roller carrier is mounted exteriorly of said hollow strut.

6. A door system according to claim 1, further comprising:

a rib positioned proximal an edge of said panel, said hollow strut straddling said rib.

7. A door system according to claim 1, wherein said plurality of hinges are located along lateral edges of said panels, said panels having upper edges, wherein said hollow strut is located proximate to said upper edge away from said lateral edge.

* * * * *